United States Patent [19]

Iwamura et al.

[11] Patent Number: 4,856,687

[45] Date of Patent: Aug. 15, 1989

[54] WATCH CASE AND BAND ATTACHMENT STRUCTURE

[75] Inventors: Hichihiro Iwamura, Sayama; Eiichi Kitabayashi, Tokorozawa, both of Japan

[73] Assignee: Citizen Watch Co., Ltd., Tokyo, Japan

[21] Appl. No.: 210,740

[22] Filed: Jun. 23, 1988

Related U.S. Application Data

[63] Continuation-in-part of Ser. No. 11,038, Feb. 5, 1987, Pat. No. 4,785,982.

[30] Foreign Application Priority Data

Feb. 21, 1986 [JP] Japan ..... 61-37050
Jul. 25, 1986 [JP] Japan ..... 61-114155

[51] Int. Cl.[4] ..... G04B 37/00; A44C 5/00

[52] U.S. Cl. ..... 224/169; 24/265 WS; D10/30; D11/3; 63/3; 368/282; 224/176; 224/164

[58] Field of Search ..... 224/164, 165, 166, 167, 224/168, 169, 170, 171, 172, 173, 174, 175, 176, 177, 178, 179; 24/265 WS; 63/3, 4, 5.1, 5.2, 6, 7; 368/282; D11/3, 86; D10/30, 31, 32, 38

[56] References Cited

U.S. PATENT DOCUMENTS

| | | | |
|---|---|---|---|
| 1,742,464 | 1/1930 | Eklund | 24/265 WS |
| 1,809,277 | 6/1931 | Kestenman | 24/265 WS |
| 2,028,791 | 1/1936 | Lynds | 224/174 |
| 2,434,144 | 1/1948 | Cleinman | 63/5.2 X |
| 3,795,353 | 3/1974 | Weiss | 224/177 |
| 4,270,201 | 5/1981 | Pyne et al. | 368/282 |
| 4,389,006 | 6/1983 | Nagata | 224/164 |
| 4,432,476 | 2/1984 | Yokosuka | 224/164 |

FOREIGN PATENT DOCUMENTS

| | | | |
|---|---|---|---|
| 0066536 | 12/1982 | European Pat. Off. | 63/3 |
| 3337889 | 4/1984 | Fed. Rep. of Germany | 63/3 |
| 38604 | 4/1907 | Switzerland | 224/164 |
| 419694 | 5/1965 | Switzerland | 24/265 WS |
| 1565378 | 4/1980 | United Kingdom | 224/168 |
| 2127673 | 4/1984 | United Kingdom | 368/282 |

*Primary Examiner*—Henry J. Recla
*Attorney, Agent, or Firm*—Koda and Androlia

[57] ABSTRACT

A structure comprising a watch case; a pair of lugs each extending from one of the sides of the watch case and being provided with a threaded hole; a band; a pair of cone point screws; a connector secured to the underside of an end portion of the band, the connector being bent into a U-shape to define a base wall and a pair of side walls, the side walls being provided with a pair of attachment openings, the band being closely attached to the watch case by placing the end portion of the band on the top surfaces of the lugs and tightening the cone point screws respectively into the threaded holes of the side lugs so that the cone points engage with the pair of attachment openings provided in the connector; and a bend preventing member comprising a bending wall extending from the base wall of the connector. The bending wall is bent so as to cause a fold in the direction of the width of the band and inserted between the pair of walls so that the bending wall can support the pair of walls of the connector from the inside so as to keep a fixed space betwen the side walls against forces exerted by the cone point screws towards the inside.

3 Claims, 3 Drawing Sheets

WATCH CASE AND BAND ATTACHMENT STRUCTURE

BACKGROUND OF THE INVENTION

This is a continuation-in-part of application Ser. No. 011,038, filed Feb. 5, 1987, now U.S. Pat. No. 4,785,982.

1. Field of the Invention

This invention relates to a watch case and band attachment structure.

2. Description of the Related Art

In a conventional watch band attachment structure, as shown in the perspective view of FIG. 1 and the sectional view of FIG. 2, a watch case 1 and a watch band 2 are connected by means of a spring bar 3. The watch case 1 is provided with lugs 1*c* having holes 1*a* for inserting pins 3*a* of the spring bar 3 and a connector hook receiving portion 1*b* for receiving a connector hook 2*a* of a connector 2'. The connector 2' is soldered to the band 2 and holds the spring bar 3 (UK Pat. No. 2,129,280). In this conventional structure, however, lugs 1*c* must be provided with holes 1*a* in their ends. For this reason, as the holes 1*a* approach nearer to the distal ends of the lugs 1*c*, the lugs 1*c* lower further and a difference H between the lower surface of the watch case 1 and the lower surface of the lug 1*c* becomes larger. Thus, there poses a problem on the appearance.

In addition, as disclosed in U.S. Pat. No. 4,389,006, there is a technique that screws 40 are tightened in threaded holes 13 respectively formed in legs 12 of a watch case 10, and tapered end portions 41, which are pressedly advanced by tightening, which cause a connecting member 30 which is inserted in a space surrounded by the watch case 10, a cover 11, a side wall 14 and legs 12 to be pressed in a direction of the center of the watch case 10 and to be held positively. In this technique, it is essential to provide the cover 11 in the watch case 10. As a result, the cover itself makes the watch case 10 large and the entire watch has a profile of a thick edge and thus deteriorates in design. Furthermore, this technique necessitates a pair of legs 12 to tighten the screws 40 positively and also necessitates a space between these legs 12. Therefore, the length required from one leg 12 to the other leg 12 is the width of each leg$\times$2 +the width of the space =, in experience, 2.5 mm $\times$2 +6 mm =11 mm in minimum. Therefore, when it is considered that the width of a band for women's watches may be small up to 6 mm, the connection of this technique cannot apply to all the band widths.

Furthermore, in U.S. Pat. No. 3,795,353, the following technique is known: Between a pair of foot portions 32 formed on U-shaped projections 30 of a connector 22, a lug 20 of a watch casing 12 is placed, then, a pin 36 is inserted into an opening 26 in the lug 20, and tabs 34 are folded to lock the pin 36 in place, thus making the connection between the watch casing 12 and the connector member 22. According to this technique, it is said that the watch casing 12 and the band section 17 are secured as if they are connected directly. However, the pin 36 is inserted into the opening 26 in the lug 20 and both ends of the pin 36 are only placed in U-shaped projections 30 so that any play cannot take place. In this state, since the connector member 22 is not positively pressed against the watch casing 12, the watch casing 12 and the connector member 22 are not integrally connected as in a direct band connection. Also, when the connector member 22 is removed from the watch casing 12, tabs 34 of the connector member 22 must be folded out to return to their original position As a result, when the tabs 34 are repeatedly folded, they may be broken. Thus this technique is inferior in practical durability. With this technique, like the above-mentioned technique of U.S. Pat. No. 4,389,006, the connector member 22 is inserted beneath the ornament 16 of the watch casing 12. Therefore, when viewed from the plane of the watch casing 12, the profile appears to be large, and this is not preferable in design. Also, when viewed from the back side, the connector member 22 is fully exposed, thus impairing the appearance of the watch.

SUMMARY OF THE INVENTION

It is an object of the invention is to keep the attractive appearance of a watch viewed from the side by preventing the lower surfaces of lugs of the watch case from lowering excessively with respect to the lower surface of the watch case when the watch case is viewed from the side.

Another object of the invention is to provide an attachment structure in which the connector is reduced in width in the direction of the width of the band so that it can also be used for women's narrow watch bands.

This invention has a structure comprising a watch case having front and back surfaces and at least two sides; a pair of lugs each extending from one of the sides of the watch case and being provided with a threaded hole and having a top surface which is lower in position than the front surface of the watch case; a band having a top side and an underside; a pair of cone point screws; a connector secured to the underside of an end portion of the band, the connector being bent into a U-shape to define a base wall and a pair of side walls and being secured in a direction of a width of the band, with the side walls extending downwardly as viewed from the top side of the band, the side walls being provided with a pair of attachment openings, the band being closely attached to the watch case by placing the end portion of the band on the top surfaces of the lugs and tightening the cone point screws respectively into the threaded holes of the side lugs so that the cone points engage with the pair of attachment openings provided in the connector; and a bend preventing member comprising a bending wall extending from the base wall of the connector, the bending wall being bent so as to cause a fold in the direction of the width of the band and inserted between the pair of walls so that the bending wall can support the pair of walls of the connector from the inside so as to keep a fixed space between the side walls against forces exerted by the cone point screws towards the inside.

BRIEF DESCRIPTION OF THE DRAWINGS

FIGS. 3 to 7 are views illustrating an embodiment of the invention, in which FIG. 3 is a perspective view illustrating lugs 6 extending from a watch case 11; FIG. 4 is a sectional view illustrating the connected state of the watch case 11 and a band 4; FIG. 5 is a sectional view illustrating a band end 4*a* and the state before and after bending a connector 5 at its bending portion; and FIG. 6 is a perspective view illustrating the attached state of the connector to the underside of the band end; and FIG. 7 is a partially sectional view taken along the line VII—VII of FIG. 4 and viewed in the direction of the arrows.

DETAILED DESCRIPTION OF THE PREFERRED EMBODIMENT

The invention will now be described in detail with reference to the drawings.

In an embodiment shown in FIGS. 3 to 7, a connector 5 is bent into a U-shape so as to define a base wall 5*c* and a pair of side walls 5*b* and 5*b*, and both the bent side walls 5*b* and 5*b* are provided with a pair of opposed attachment openings 5*a* and 5*a*. The base wall 5*c* of the connector 5 is attached to an underside 4*c* of a band end 4*a*, and from one end of the base wall 5*c*, a bending wall 5*d* extends and is bent so as to cause a fold 5*e* in the direction of the width of the band. This bending wall 5*d* occupies the space between the pair of side walls 5*b* and 5*b*, keeps the space constant and covers the inside of the connector 5 including screws 8. The fold 5*e* between the base wall 5*c* and the bending wall 5*d* is struck along the line of the fold in the direction of the width of the band so as to reduce the thickness of the fold 5*e* for facilitating bending. Furthermore, the center portion of the bending wall 5*d* is bent so as to cause a fold in the direction of the width of the band so that the upper surface of the bending wall 5*d* agrees with the shapes of top portions of the side walls 5*b* and 5*b*. By doing this, strength to resist a buckling load is increased and thus this structure completely prevents the side walls 5*b* and 5*b* from falling down inside.

Figure 1:
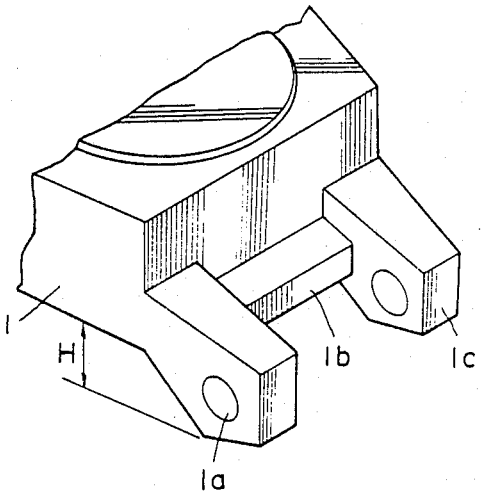
FIG. 1 (PRIOR ART)
FIG. 1 is a perspective view of a watch case and lugs of a conventional structure.
Figure 2:
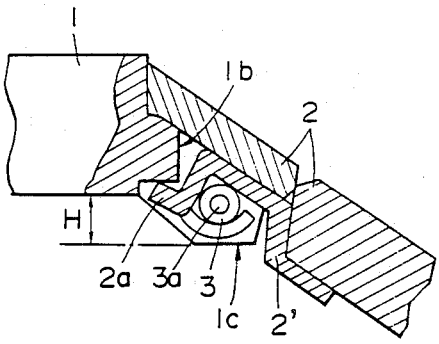
FIG. 2 (PRIOR ART)
FIG. 2 is a sectional view illustrating the connected state of the watch case and a band of the conventional structure.
Figure 3:
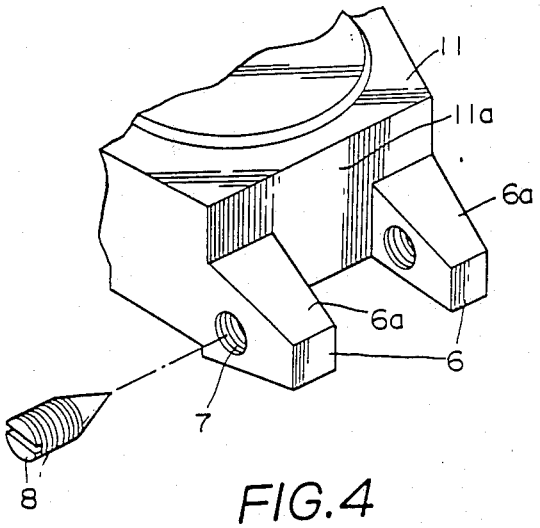
Figure 4:
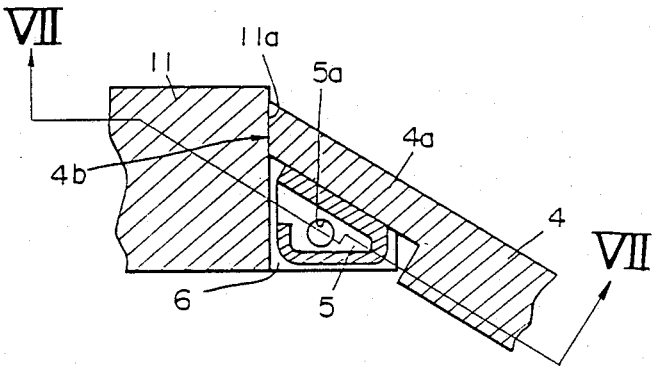
Figure 5:
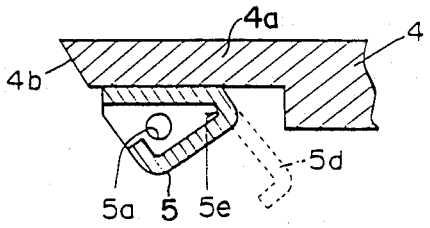
Figure 6:
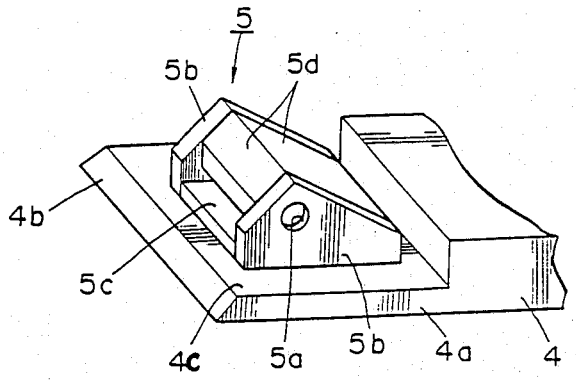
Figure 7:
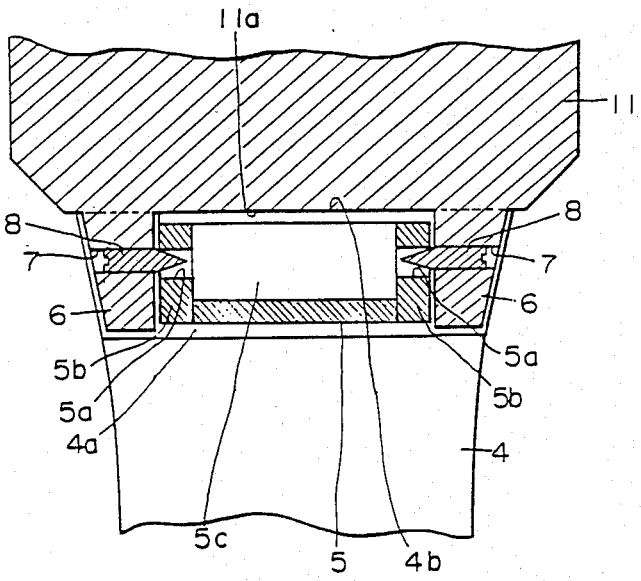

The watch case and the band are attached as follows: First, the underside 4*c* of the band end 4*a* is placed on the upper surfaces of a pair of lugs 6*a* and 6*a* of the watch case 11, then cone point screws 8 and 8 are tightened into threaded holes 7 and 7 provided in the lugs 6 and 6 from the outside. Thus as shown in FIG. 7, as the screws 8 and 8 are rotated and driven into the threaded holes 7 and 7, the tapered surfaces of the cone points of the screws 8 and 8 push the abutment portions of the openings 5*a* and 5*a* in the connector 5 against the case 11, so that the band 4 together with the connector 5 is held against the watch case 11 and thus an edge 4*b* of the band 4 is attached to a side wall 11*a* of the watch case 11 without any clearance. As already mentioned, since the surface of the bending wall 5*d* of the connector 5 is bent so as to cause a fold in the direction of the width of the band and strength to resist a buckling load is increased. Therefore, even if the screws are excessively tightened, side walls will never fall down.

As described above, according to the structure of the invention, the threaded holes in the sides of the lugs can be provided near the distal ends of the lugs, and the lower surfaces of the lugs approach the lower surface of the watch case accordingly, thus providing the attractive appearance of the watch viewed from the side. In addition, there is no possibility of injuring the wrist of the wearer because the connector at the attachment portion little extends from the lower surfaces of the lugs. Furthermore, since the connector of the invention is small in width, it can also be used for women's narrow bands.

What is claimed is:

1. A structure comprising:

a watch case having front and back surfaces and at least two sides;

two pairs of lugs, each pair extending from one of said sides of said watch case and each lug being provided with a threaded hole and having a top surface which is lower in position than said front surface of said watch case;

a band having opposite end portion with a top side and an underside;

a pair of cone point screws;

a connector secured to said underside of each end portion of said band, said connector being bent into a U-shape to define a base wall and a pair of side walls said base wall being secured to said underside in a direction of a width of the band, with said side walls extending downwardly as viewed from said top of the band, said side walls being provided with a pair of attachment openings, said band being closely attached to the watch case by placing each end portion of the band on the top surfaces of the lugs and tightening the cone point screws respectively into the threaded holes of the side lugs so that the cone points engage with the pair of attachment openings provided in said connector, said end portions of the band and sides of the watch case being configured so that the band together with tee connector is held against the watch case, and so that an edge of the band is attached to the side wall of the watch case without any clearance; and a bend preventing member comprising a bending wall extending from said base wall of said connector, said bending wall being bent so as to cause a fold in the direction of the width of the band and inserted between said pair of side walls so that the bending wall can support the pair of walls of the connector from the inside so as to keep a fixed space between the side walls against forces exerted by said cone point screws towards the inside.

2. The structure according to claim 1 wherein the fold between the base wall and the bending wall is struck along a line of the fold so as to reduce the thickness of the fold for facilitating bending.

3. The structure according to claim 1 wherein a center portion of the bending wall is bent so as to cause a fold in the direction of the width of the band so that the upper surface of the bending wall agrees with the shapes of the top portions of the side walls.

* * * * *

UNITED STATES PATENT AND TRADEMARK OFFICE

CERTIFICATE OF CORRECTION

PATENT NO. : 4,856,687

DATED : August 15, 1989

INVENTOR(S) : MICHIHIRO IWAMURA, et al

It is certified that error appears in the above-identified patent and that said Letters Patent is hereby corrected as shown below:

On the title page:

Item [75] Inventors: Change "Hichihiro Iwamura, Sayama; Eiichi Kitabayashi, Tokorozawa, both of Japan" to --Michihiro Iwamura, Sayama; Eiichi Kitabayashi, Tokorozawa, both of Japan--

Signed and Sealed this

Twelfth Day of June, 1990

*Attest:*

HARRY F. MANBECK, JR.

*Attesting Officer*

*Commissioner of Patents and Trademarks*